United States Patent [19]

Kinoshita

[11] Patent Number: 4,902,927

[45] Date of Patent: Feb. 20, 1990

[54] STREAK TUBE

[75] Inventor: Katsuyuki Kinoshita, Shizuoka, Japan

[73] Assignee: Hamamatsu Photonics Kabushiki Kaisha, Shizuoka, Japan

[21] Appl. No.: 189,256

[22] Filed: May 2, 1988

[30] Foreign Application Priority Data

May 1, 1987 [JP] Japan ..... 62-108575

[51] Int. Cl.[4] ..... H01J 31/50; H01J 40/08

[52] U.S. Cl. ..... 313/376; 313/381; 313/382; 313/541; 313/544

[58] Field of Search ..... 313/373, 376, 381, 382, 313/383, 541, 542, 544, 413, 529

[56] References Cited

U.S. PATENT DOCUMENTS

| | | | |
|---|---|---|---|
| 3,391,295 | 7/1968 | Clayton | 313/381 |
| 3,432,711 | 3/1969 | Clayton | 313/381 |
| 4,350,919 | 9/1982 | Johnson et al. | 313/529 |
| 4,684,808 | 8/1987 | Plies et al. | 250/396 R |

FOREIGN PATENT DOCUMENTS

| | | | |
|---|---|---|---|
| 0175933A1 | 4/1986 | European Pat. Off. . | |
| 61-80741 | 4/1986 | Japan | 313/382 |
| 1189474 | 4/1970 | United Kingdom . | |
| 1563819 | 4/1980 | United Kingdom . | |
| 2094545A | 9/1982 | United Kingdom . | |

*Primary Examiner*—Palmer C. DeMeo
*Assistant Examiner*—Sandra L. O'Shea
*Attorney, Agent, or Firm*—Finnegan, Henderson, Farabow, Garrett and Dunner

[57] ABSTRACT

A streak tube comprising a photocathode for converting an optical image into a photoelectron beam, accelerating means for accelerating the photoelectron beam, deflecting means for deflecting the accelerated photoelectron means, focusing means for focusing the deflected photoelectron beam and a phosphor screen for receiving the focused photoelectron beam and forming a streak image corresponding to the optical image. The photoelectron beam emitted from the photocathode is deflected immediately after accelerated by the accelerating means, and subsequently is focused on the phosphor screen, to thereby eliminate the spread of the photoelectron beam on the phosphor screen upon sweeping of the photoelectron beam.

10 Claims, 5 Drawing Sheets

STREAK TUBE

BACKGROUND OF THE INVENTION

The present invention relates to a streak apparatus suitable for use in such applications as the measurement of time-dependent distribution of intensity in phenomena such as light emission.

A streak apparatus employs a streak tube for measuring the time-based intensity distribution of incident light by converting it into a spatial distribution of intensity on a phosphor screen. Since the streak apparatus can provide a time resolution of up to the order of picoseconds, it is particularly adaptive to analysis of light emission whose intensity changes at extremely short intervals.

The composition and operation of a conventional streak tube are first described hereinafter.

FIG. 1A is a cross sectional view of a conventional streak tube as viewed from the side of the photocathode, and FIG. 1B is a longitudinal sectional view of the streak tube taken on a plane that includes the tube axis and is parallel to the deflecting electrodes. FIG. 2A is another cross sectional view of the conventional streak tube as viewed from the side of the photocathode, and FIG. 2B is a longitudinal sectional view of the streak tube taken on a plane that includes the tube axis and is perpendicular to the deflecting electrodes. FIG. 3 is a diagram showing the profile of a voltage to be applied to the deflecting electrodes. In these figures, reference numeral 1 is a vacuum air-tight container, 2 is an incident window, 3 is a photocathode, 4 is a mesh electrode, 5 is a focusing electrode, 6 is an anode plate (aperture electrode), 8 is an exit window, 9 is a phosphor screen, 10 is an optical image; 11 is the principle orbit of electron beam, and 12 is a $\beta$-orbit of an electron beam which is defined hereinafter.

As shown in the figures, the vacuum air-tight container 1 of the streak tube is provided at one end thereof with an incident window 2 upon which an optical image to be analyzed is incident, and at the other end thereof with an exit window 8 from which the processed optical image emerges. The incident window 2 is provided with a photocathode 3 on the inner surface thereof, and the exit window 8 is provided with a phosphor screen 9 on the inner surface thereof. A mesh electrode 4, a focusing electrode 5, anode 6 and deflecting electrodes 7 are arranged in this order between the photocathode 3 and the phosphor screen 9 along the tube axis of the container 1.

The photocathode 3, focusing electrode 5, mesh electrode 4 and the anode 6 having a central aperture are supplied with increasing voltages in this order and the phosphor screen 9 and the anode 6 are connected to the same potential. Assuming that a linear optical image 10 is projected onto the photocathode 3 through the incident window 2 by means of a certain device (not shown) in such a manner that the image passes through the center line of the photocathode 3. The photocathode 3 then emits a photoelectron image that corresponds to the optical image. The emitted electrons are accelerated with the mesh electrode 4, are focused with the focusing electrode 5, pass through the central aperture in the anode 6, and travel through the gap space between the deflecting electrodes 7 toward the phosphor screen 9.

The deflecting electrodes 7 between which the linear electron image passes are supplied with, for example, a deflection voltage that changes with time as shown in FIG. 3. The direction of the electric field produced by this voltage is perpendicular to the tube axis and the linear electron image (i.e., in the direction perpendicular to the surface of the drawing of FIG. 1B) and its intensity is proportional to the applied deflection voltage. The deflection voltage allows the linear electron beam to be swept across the phosphor screen 9 in a direction perpendicular to the line of the linear electron beam (i.e., in the direction indicated by arrow S in FIG. 2B) in such a manner that linear output light images corresponding to the linear optical image projected on to the photocathode 3 are successively arranged on a time basis in a direction perpendicular to the longitudinal direction of the line, thereby producing a "streak image" on the phosphor screen 9. Therefore, by measuring quantitatively the change in luminance in the direction in which the streak image is formed, that is, in the sweep direction, the time-dependent change in the intensity of the optical image incident on the photocathode 3 is determined. As the width (W) of the linear output light image obtained on the phosphor screen is narrowed, the time resolution that can be attained is higher.

Many photoelectrons are emitted from a point on the photocathode 3 at the same time at various angles with various energies. For instance, photoelectrons emitted from point P of the linear optical image on the photocathode 3 have an initial energy distribution ranging from zero to several electron volts. The direction of their emission also ranges from the one that is perpendicular to the photocathode 3 to those having angles of $\theta(0° < \theta < 90°)$ with respect to the normal to the photocathode 3. If these photoelectrons are allowed to travel straightforwardly, they will become divergent to produce a blurred electron image. Therefore, in order to focus the divergent photoelectrons on the phosphor screen, an electron lens formed by a focusing electrode is employed.

The following description is made on transitorbits of photoelectrons when no deflection voltage is applied between a pair of deflecting plates *7a* and *7b*. If the photoelectrons are emitted from the photocathode 3 with an initial energy of zero, they will transit on the orbit 11 which is hereunder referred to as the principle orbit. The other electrons will travel on the orbits 12 which are hereunder referred to as $\beta$-orbits. There are an infinite number of $\beta$-orbits 12 and they depart farther away from the principle orbit 11 as photoelectrons are emitted from the photocathode at larger angles of $\theta$ with respect to the normal to the photocathode and as they have greater initial energies. For the sake of convenience of the following description, the $\beta$-orbits 12 are to be represented by those of the photoelectrons with an energy of 1 eV that are emitted from the photocathode 3 symmetrically with the principle orbit 11 at an angle of 60° with respect to the normal to the photocathode 3.

If it is supposed that the photoelectrons traveling on the principle orbit 11 impinge on the phosphor screen 9 at point P', the photoelectrons traveling on any $\beta$-orbit 12 can be allowed to impinge on the phosphor screen at a point in substantial coincidence with point P' by properly adjusting the voltage to be applied to the focusing electrode 5.

As shown generally in FIG. 2B, photoelectrons traveling on the $\beta$-orbit 12 first depart away from the principle orbit 11 but are thereafter subjected to the force acting toward the principle orbit that is produced by the electron lens formed of the focusing electrode 5. Therefore, the distance between the principle orbit 11 and the photoelectrons traveling on the $\beta$-orbits 12 becomes the greatest in the vicinity of the end of the focusing electrode 5 which is on the side of the aperture electrode 6. The photoelectrons are then subjected to the velocity component acting toward the principle orbit 11 and the focusing effect of the electron lens disappears in the middle area between the aperture electrode 6 and the deflecting electrodes 7. Thereafter, the photoelectron beam makes a linear motion at a velocity substantially corresponding to the voltage applied between the photocathode 3 and the aperture electrode 6 and approaches the principle orbit until it impinges on the phosphor screen 9 at point P'. In this way, the photoelectrons that were emitted from the photocathode at various angles and with various energies are focused at a point that substantially coincides with point P', thereby decreasing the width of beam spread, W, on the phosphor screen.

However, if a sweep voltage is applied between the deflecting electrodes, the width of beam spread, W, on the phosphor screen will increase in the sweep direction. Let us first discuss this problem with reference to the static case where the change in deflection voltage is so slow that it may be regarded as zero during the passage of an electron beam through the deflection space.

FIG. 4 shows only the deflecting electrodes and the phosphor screen as isolated from the other components of the streak tube. Beam A in FIG. 4 denotes photoelectrons travelling on the principle and $\beta$-orbits when a deflection voltage of +VD (positive) is applied to the deflecting plate *7a* and a voltage of −VD (negative) applied to the deflecting plate *7b*. Beam C denotes photoelectrons traveling on the principle and $\beta$-orbits when a negative voltage of −VD is applied to the deflecting plate *7a* and a positive voltage of +VD applied to the deflecting plate *7b*. Each of the beams A and C is the result of deflection of beam B which would be focused on a single point on the phosphor screen 9 in the absence of deflection voltage. As shown, each of the beams A and C produces a spread on the phosphor screen 9 which results from the difference between the amounts of deflection of electrons (a) and (b) on $\beta$-orbits.

FIG. 5 shows equipotential surfaces created around the deflecting electrodes 7 when the absolute value of VD is 500 volts. As for the electron beam A, electron (a) traveling on $\beta$-orbit near the input end of the deflecting electrodes 7 is closer to the deflecting plate *7a* supplied with +500 volts, so that this electron is accelerated in the direction of the tube axis by the force Fa. On the other hand, electron (b) traveling on another $\beta$-orbit is closer to the deflecting plate *7b* supplied with −500 volts, so that this electron is decelerated by the force Fb. As a result, electron (b) will travel through the deflection field more slowly than electron (a) and hence is deflected by a greater amount than electron (a). This relationship between electrons (a) and (b) is reversed in the case of beam C. As a consequence, electron beams traveling toward the peripheral edge of the phosphor screen 9 will be focused in the front of the phosphor screen 9 and produce a spread Ws when they encounter the screen. The amount of this beam spread increases as the beam is deflected farther away from the center of the phosphor screen 9. The beam spread Ws is one of the major causes of deteriorated time resolution of the streak tube.

Assuming the sweeping speed of the beam on the phosphor screen 9 is represented by Vs, the time resolution of streak tube, $\Delta t$, as defined by the beam spread Ws is expressed by:

$$\Delta t = Ws/Vs.$$

If a beam spread occurs only in the area having a large deflecting angle, there will be no problem so long as the effective central area of the phosphor screen and the range of small deflection angles are selectively used.

Let us then consider the dynamic case where the change in deflection voltage is so rapid that it cannot be substantially neglected when electrons are traveling through the deflection space.

FIG. 6 shows the waveforms of deflection voltages to be applied to the deflecting electrodes. When the deflecting plate *7a* is supplied with a linearly changing ramp voltage $Vd_1(t)$ and the deflecting plate *7b* is supplied with another ramp voltage $Vd_2(t)$, the voltage applied between the two deflecting plates at time t is expressed by: $Vd_1(t) - Vd_2(t)$.

If the change in two ramp voltages that occurs when photoelectrons are traveling between the deflecting electrodes is negligibly smaller than the beam accelerating voltage applied between the photocathode and the aperture electrode, the conclusion already stated in connection with the application of a dc deflection voltage can be applied to this case.

If photoelectrons traveling from the photocathode to the aperture electrode are accelerated to about 10 keV, the velocity component parallel to the tube axis is about $6 \times 10^7$ m/s in the area of the deflecting electrodes. If the deflecting electrodes are 12 mm in length, it will take about 200 ps for the photoelectrons to pass through the gap space between the two deflecting electrodes. Therefore, if the change in the ramp voltage shown in FIG. 6 is no more than about 3 kV per $\mu$s, the change in the deflection voltage that occurs when photoelectrons are passing through the gap space between the deflecting electrodes is only about 0.3 V, which is so much smaller than the accelerating voltage of 10 keV that one may safely disregard it and apply the theory applicable to the case where a dc deflecting voltage is supplied. However, if the deflection voltage changes by as much as 3 kV during the period of 200 ps when photoelectrons are passing through the deflection field, the beam spread on the phosphor screen will come out in a somewhat different manner.

FIG. 7 shows how an electron beam spreads when a substantial change occurs in the deflection voltage. As in the case of the application of a dc deflection voltage, electrons moving slowly in the direction of tube axis are more subject to the action of the deflection field than fast moving electrons. However, when the deflection voltage is changing very rapidly, electrons (a) and (b) (on $\beta$-orbits) in each of the beams A, B and C have a different velocity relationship in the direction of tube axis than in the case where a dc deflection voltage is applied, and a very rapidly changing ramp voltage is also exerted upon beam B traveling toward the center of the phosphor screen 9.

Referring to the case as shown in FIG. 7, beam B passing between the deflecting electrodes is initially deflected toward deflecting plate *7a* since at the time of beam incidence, a positive voltage is applied to the deflecting plate *7a* and a negative voltage applied to the deflecting plate *7b*. In the mean time, the potential relationship between the plates *7a* and *7b* is reversed and the beam B is deflected toward the plate 7*b*. As a consequence of these changes in deflection voltage, the beam B is finally converged to reach the center of the phosphor screen.

Such a rapidly and greatly changing deflection voltage will cause different effects on the orbits of electrons than when a dc deflection voltage is applied and it is not easily determined what the beam spread will become unless electron orbits are analyzed by computer simulation. According to analysis by this technique, the beam spread Wd is the widest on the center of the phosphor screen and the way in which an electron beam spreads on the phosphor screen also differs more considerably at large deflection angles than that in the case where a dc deflection voltage is applied.

Computer simulation has also shown that the beam spread that occurs when a rapidly changing deflection voltage is applied is substantially the same as what is produced on the phosphor screen when a dc deflecting voltage is applied and the voltage being applied to the focusing electrode is adjusted in such a manner that a photoelectron beam will be focused on a plane ahead of the phosphor screen as indicated by dashed lines in FIG. 7. Therefore, if a preadjustment is made in such a manner that in a static state, an electron beam will be focused at a point (static focal point F in FIG. 8) which lies on the center line passing through the phosphor screen, but is suitably in the front of the phosphor screen the beam can accurately be focused on the phosphor screen in sweep mode, thereby preventing the beam spread that would be created by the deflection voltage. This technique has been conventionally used to prevent the beam spread that occurs when a rapidly changing deflection voltage is applied.

The focusing plane can be adjusted by changing the voltage to be applied to the focusing electrode; if the voltage on the focusing electrode is shifted in the negative direction, the focusing plane is shifted to a position ahead of the phosphor screen (i.e., toward the photocathode). In this way, the position of a focusing plane can be adjusted by adjusting the voltage on the focusing electrode.

However, the degree by which the beam focusing point is shifted ahead of the phosphor screen as a result of sweeping operation, differs with the sweep speed and, therefore, the amount by which the voltage applied on the focusing electrode must be shifted in the negative direction is also dependent on the sweep speed. In other words, a change in sweep speed necessitates a corresponding adjustment in the voltage applied to the focusing electrode. As a further problem, if a light beam to be measured contains extremely intense light pulses, a photoelectron beam of high density is produced and the repulsion of emitted electrons by the space-charge effect causes the diameter of the beam to be increased in sweep direction (i.e., the distance between electrons (a) and (b) in FIGS. 4 and 5) when it is passed between the deflecting electrodes. Unlike the increase in beam size that occurs on account of the energy or angle of electron emission from the photocathode, the beam size that has increased as a result of repulsion of photoelectrons during its transit period from the photocathode to the deflection electrodes has to be compensated by applying another focusing voltage. Therefore, in practice, it is very difficult to adjust the voltage on the focusing electrode in accordance with the change in the intensity of a light beam to be measured.

Another problem with the increase in the intensity of light pulses to be measured is that it causes a spread of the photoelectron beam not only in the sweep direction but also in the direction of the axis of the streak tube, and this is another cause of deterioration in the time resolution that can be attained by the streak tube. FIG. 9 illustrates how a photoelectron beam spreads in the direction of the tube axis when an extremely intense light impulse is applied to the streak tube. Upon incidence of such a light impulse, pulses of a very narrow width in the form of clouds of a great number of photoelectrons are emitted from the photocathode in the direction of tube axis, and by the time when they are launched between the deflecting electrodes, they will have spread in the direction of the tube axis by the space-charge effect as shown by a line A-B. If such spread pulses are deflected by a ramp voltage applied to the deflecting electrodes, a pulse spread will be produced on the phosphor screen as indicated by line A'-B'.

SUMMARY OF THE INVENTION

The present invention has been accomplished in order to solve the aforementioned disadvantages of the prior art. An object of the invention is to provide a streak tube that attains high time resolution by eliminating the spread of a photoelectron beam that would be produced on a phosphor screen upon sweeping of photoelectron beams.

In order to attain the aforementioned object of the present invention, the streak tube according to this invention includes a photocathode for converting an optical image into a photoelectron beam, accelerating means for accelerating the photoelectron beam emitted from the photocathode, deflecting means for deflecting the photoelectron beam accelerated by the accelerating means, focusing means for focusing the deflected photoelectron beam and a phosphor screen for receiving the focused photoelectron beam and forming a streak image corresponding to the optical image, the photoelectron beam emitted from the photocathode being deflected immediately after its acceleration, and the deflected photoelectron beam being subsequently focused on the phosphor screen.

In the streak tube of the present invention, a photoelectron beam emitted from the photocathode is deflected immediately after it is accelerated and the deflected photoelectron beam is subsequently focused on the phosphor screen, so that a beam spread that would be produced both in the sweeping direction and in the direction of the tube axis by deflection of the photoelectron beam and by the space-charge effect can be eliminated and high time resolution can be attained.

DETAILED DESCRIPTION OF THE INVENTION

Preferred embodiments of the present invention will be described herein with reference to the accompanying drawings.

Figure 10:
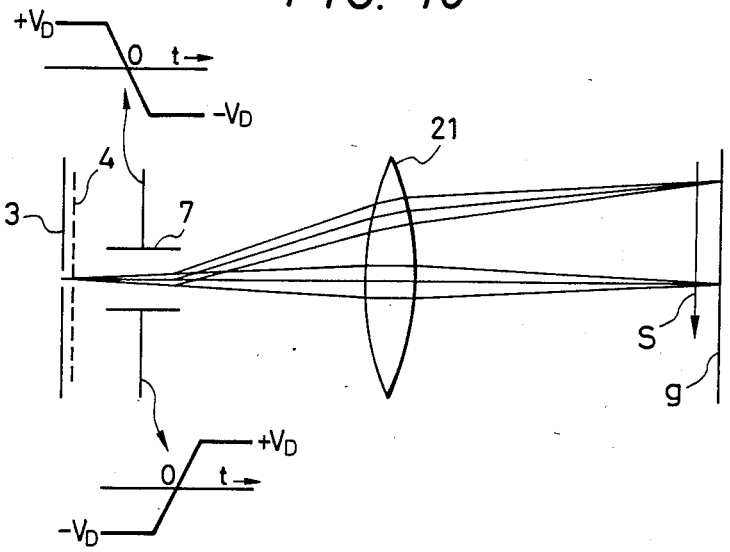
FIG. 10 is a diagram showing the basic operating principle of the streak tube of the present invention.

FIG. 10 shows the basic operating principle of the streak tube of the present invention. In FIG. 10, a focusing lens is denoted by a reference numeral 21 and the sweep direction is indicated by a character S.

Figure 4:
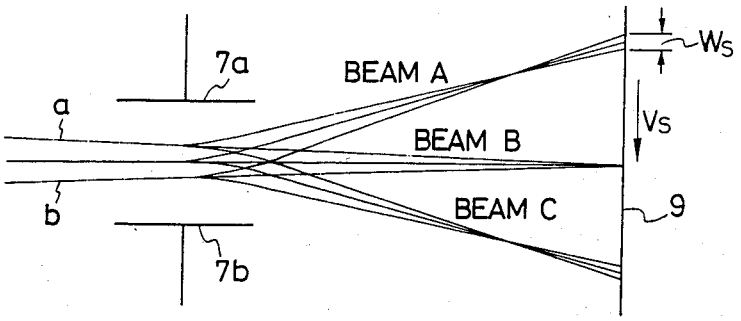
FIG. 4 shows deflecting electrodes and a phosphor screen as isolated from the other components of a streak tube for the convenience of explanation.
Figure 5:
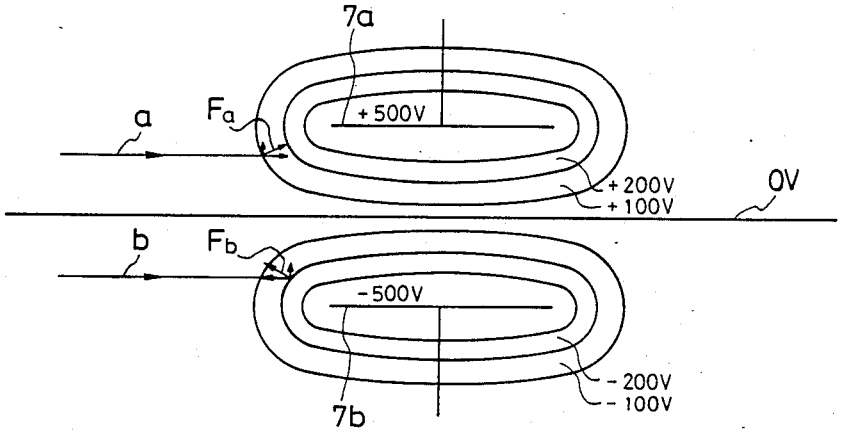
FIG. 5 is a diagram showing equipotential surfaces created around the deflecting electrodes.
Figure 6:
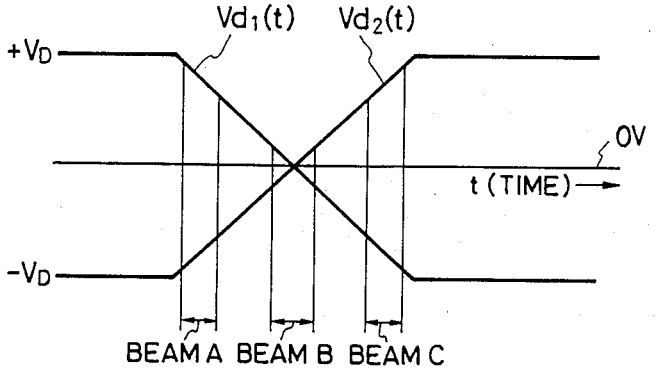
FIG. 6 is a diagram showing the waveforms of deflection voltages.
Figure 7:
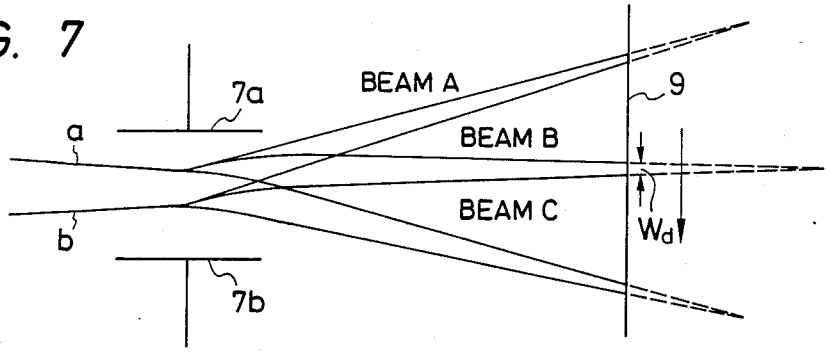
FIG. 7 shows how a photoelectron beam spreads when the deflection voltage is changed rapidly.
Figure 8:
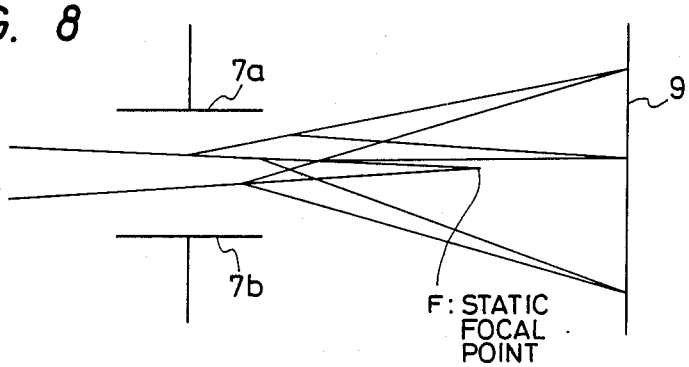
FIG. 8 is a diagram showing how a photoelectron beam is swept when a static focal point is formed in the front of the phosphor screen.
Figure 9:
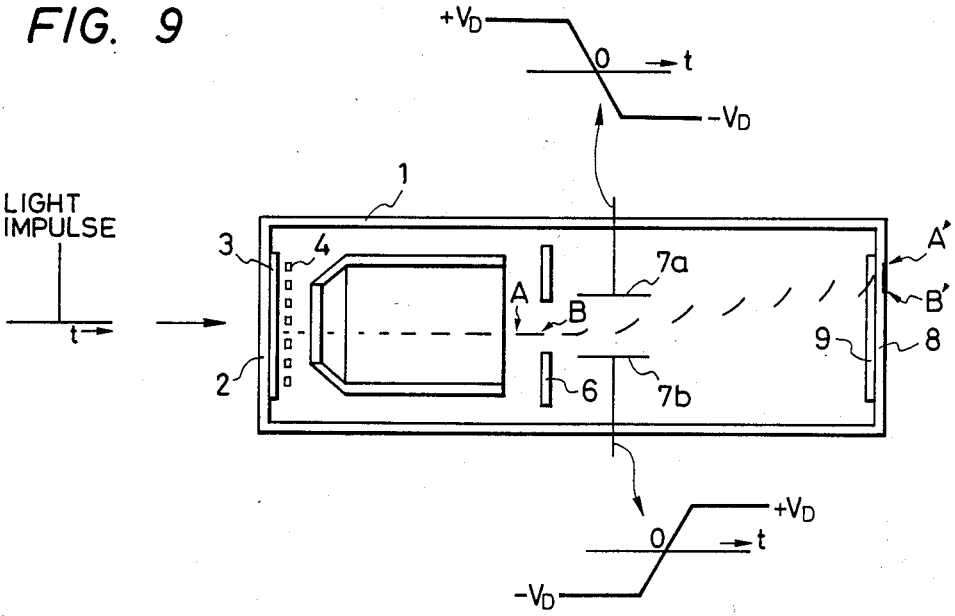
FIG. 9 illustrates how a photoelectron beam spreads in the direction of tube axis when an extremely intense light impulse is incident to a streak tube.

As already mentioned, a photoelectron beam impinging the phosphor screen spreads when it is swept with deflecting electrodes because the beam, when it is launched into the deflection field, has a certain size in the direction in which it is to be swept and in the direction of a tube axis. If this beam size is substantially reduced to zero (i.e., the distance between electrons (a) and (b) as shown in FIGS. 4 and 5 is substantially reduced to zero both in the sweep direction and in the direction of the tube axis when they are launched into the deflection field), there will be no beam spread that is produced on the phosphor screen in sweep mode. As shown in FIG. 10, the size of a photoelectron beam emitted from the photocathode 3 is still kept small for a certain period of time after it passes through the mesh electrode 4. On the basis of this fact, deflecting electrodes 7 are disposed closely adjacent to the output side of the mesh electrode and sweeping of the photoelectron beam emitted from the photocathode is completed before it is caused to spread by the initial velocities of the individual photoelectrons in that beam. Electrodes for focusing the photoelectron beam are disposed behind the deflecting electrodes. This is the basic operating principle of the streak tube of the present invention.

In the conventional streak tube, the components are arranged in the order of a photocathode, a mesh electrode, a focusing electrode, an aperture electrode, deflecting electrodes, and a phosphor screen. In the streak tube of the present invention, the components are arranged in the order of a photocathode, a mesh electrode, deflecting electrodes, a focusing electrode, an anode and a phosphor screen.

If a photoelectron beam is deflected and then focused, a linear photoelectron image that corresponds to the linear optical image formed on the photocathode will be focused on the phosphor screen 9 as indicated in FIG. 10.

Figure 1A:
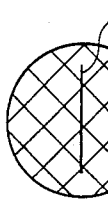
FIG. 1A is a cross sectional view of a conventional streak tube as viewed from the side of a photocathode.
Figure 1B:
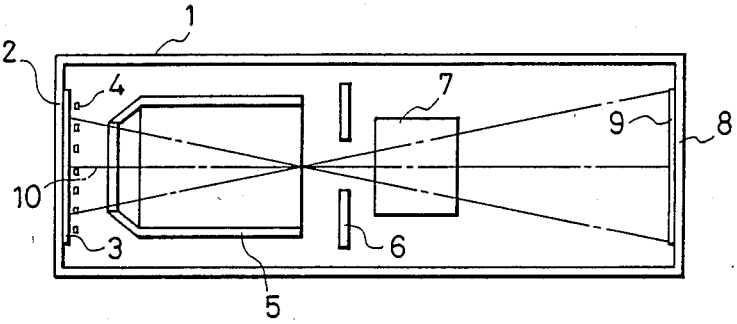
FIG. 1B is a longitudinal sectional view of the conventional stream tube taken on a plane that includes the tube axis and is parallel to the deflecting electrodes.
Figure 2A:
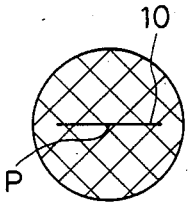
FIG. 2A is another cross sectional view of the conventional streak tube as viewed from the side of a photocathode.
Figure 2B:
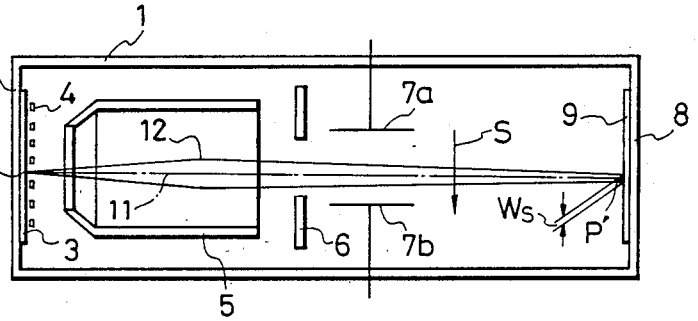
FIG. 2B is a longitudinal sectional view of the conventional streak tube taken on a plane that includes the tube axis and is perpendicular to the deflecting electrodes.
Figure 3:
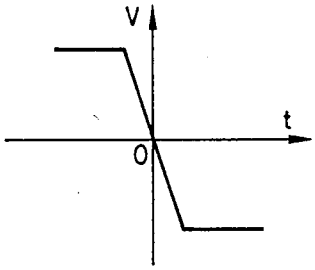
FIG. 3 is a diagram showing the waveform of a voltage to be applied to deflecting electrodes.
Figure 11:
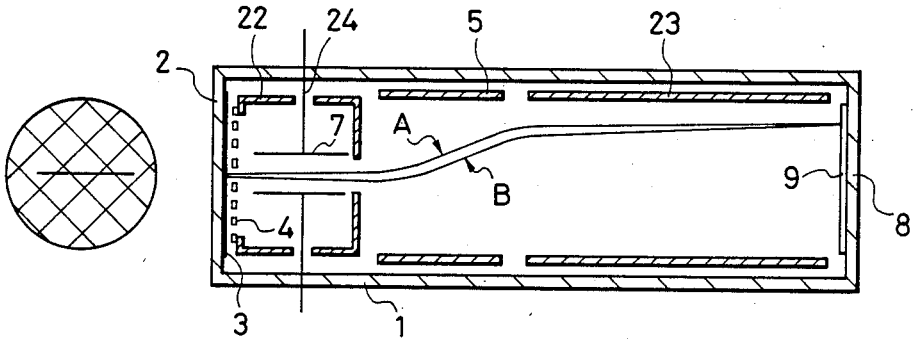
FIG. 11 is a diagram showing a streak tube according to one embodiment of the present invention.

FIG. 11 is a cross sectional view of a first embodiment of the streak tube according to the present invention taken on a plane that includes the tube axis and is perpendicular to the deflecting electrodes. The components which are the same as those shown in FIGS. 1 and 2 are identified by like numerals. The numerals 22, 23 and 24 denote a mesh electrode support, an anode and a hole, respectively.

The streak tube shown in FIG. 11 is evacuated and is composed of an incident window 2, a photocathode 3, a mesh electrode 4, deflecting electrodes 7, a cylindrical focusing electrode 5, a cylindrical anode 23, a phosphor screen 9, and an exit window 8. A high-voltage source (not shown) supplies, for example, −10 kV to the photocathode 3, −8.5 kV to the mesh electrode 4, and approximately −8.7 kV to the focusing electrode 5 through a variable resistor so as to adjust the intensity of the electron lens in such a manner that a linear photoelectron image corresponding to the linear optical image on the photocathode will be focused most appropriately on the phosphor screen. The anode 23 and the phosphor screen 9 are grounded to be at zero volts. The deflecting electrodes 7 are positioned immediately behind the mesh electrode 4 typically at an interval of about 2 mm. The deflecting electrodes 7 are about 20 mm in length in the direction of tube axis. Unlike the focusing electrode 5, the deflecting electrode 7 is not symmetrical with respect to the tube axis and their geometry will distort the electron lens formed of the focusing electrode. That is, the focusing electrode is designed with rotational symmetry to thereby generate a symmetrical electric field with respect to the tube axis, whereas the deflecting electrode is not symmetrical with respect to the tube axis to form a two-dimensional lens and therefore generates a distorted electric field. Such a distorted electric field causes the symmetrical electric field in the focusing electron lens system formed by the focusing electrode to be distorted. Therefore, in order to minimize the adverse effect that would be exerted upon the electron lens formed of the focusing electrode, the deflecting electrodes are shielded both with a cylindrical member that is formed by extending the mesh electrode support 22 in the direction of tube axis and with a lid having a central aperture in alignment with the tube axis. A deflection lead is inserted through holes 24 formed in the side wall of the cylindrical member.

The streak tube shown in FIG. 11 is operated as follows. First, an incident light beam is focused on the photocathode to form a linear optical image whose longitudinal direction is perpendicular to the drawing. The linear optical image formed on the photocathode has width of about 20 μm in the sweep direction. The photocathode emits a photoelectron beam corresponding to the linear optical image and this beam is accelerated by the mesh electrode 4. Since the deflecting electrodes 7 are positioned right ahead of the mesh electrode, the photoelectron beam that has passed through the mesh electrode is immediately deflected by the ramp voltage applied to the deflecting electrodes. Consider here two orbits, A and B, of photoelectrons that are emitted from the photocathode symmetrically with respect to the principle electron orbit at an angle of 60° with respect to the normal to the photocathode and with an energy of 1 eV. In this case, the width of the photoelectron beam as measured in sweep direction is 0.18 mm at the entrance of the deflection field and this value is significantly smaller than 2 mm, which is the width of a photoelectron beam as measured in sweep direction at the entrance of the deflection field in the conventional streak tube having a focusing electrode and an aperture electrode disposed between the photocathode and the deflecting electrodes (see FIG. 2). As a result, the spread of a photoelectron beam that is produced by sweeping with the deflecting electrodes can be reduced to a very small level. After passing between the deflecting electrodes 7, the photoelectron beam is focused by the focusing electrode 5 to form a streak image on the phosphor screen 9. The streak tube described above has the advantage that it eliminates the need to perform cumbersome compensations because the beam spread produced on the phosphor screen on account of sweeping is negligibly small. Even if the incident light is composed of extremely intense pulses, the beam spread produced by the space-charge effect is so small when the photoelectron beam has passed between the deflecting electrodes that deterioration in time resolution due to sweeping can be effectively reduced.

Figure 12:
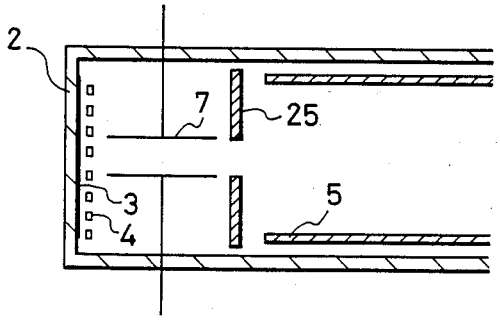
FIG. 12 is a diagram showing a streak tube according to another embodiment of the present invention.

FIG. 12 shows another embodiment of a streak tube according to the present invention. In this embodiment, an isolating aperture electrode 25 is inserted between the pair of deflecting electrodes 7 and the focusing electrode 5 and is supplied with a different voltage from that of the mesh electrode 4, so that the focusing lens comprising the isolating aperture electrode 25, the focusing electrode 5 and the anode 23 can be provided with high spatial resolution and less distortion of the electric field thereof. For example, the photocathode, the mesh electrode, the isolating aperture electrode, the focusing electrode and the anode are supplied with −10KV, −8,5KV, −8KV, −9KV and 0kV, respectively. Further, by providing the isolating aperture electrode, the focusing electrode disposed behind the deflecting electrode can be designed with a high degree of freedom of the voltage to be supplied thereto. In a case where no separating means is provided between the deflecting and focusing electrodes, for example, in the case as shown in FIG. 11, the lid of the cylindrical member 22 is supplied with the same potential as the mesh electrode and therfore the design of the focusing electrode forming an electon lens system located behind the lid is restricted in degree of freedom. If any separating means is provided as shown in FIG. 12, a suitable voltage different from that of the mesh electrode is applied to the separating means, so that a focusing electrode forming an optimum focusing electron lens system is easily and arbitrarily designed with high spatial resolution and no distortion.

Figure 13:
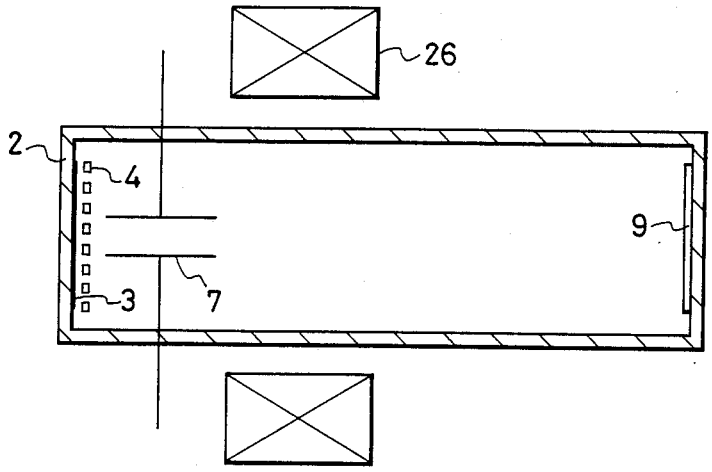
FIG. 13 is a diagram showing an electromagnetic focusing streak tube according to still another embodiment of the present invention.

FIG. 13 shows an electromagnetic focusing streak tube according to still another embodiment of the present invention. As in the previous embodiments, deflecting electrodes are positioned right behind the mesh electrode in this third embodiment. The difference is that a focusing coil 26 is positioned between the pair of deflecting electrodes and the phosphor screen. The photocathode is supplied with −10 kV, whereas the mesh electrode and the phosphor screen are at zero volts. The deflecting electrodes are supplied with a ramp voltage having the waveform shown in FIG. 10.

Figure 14:
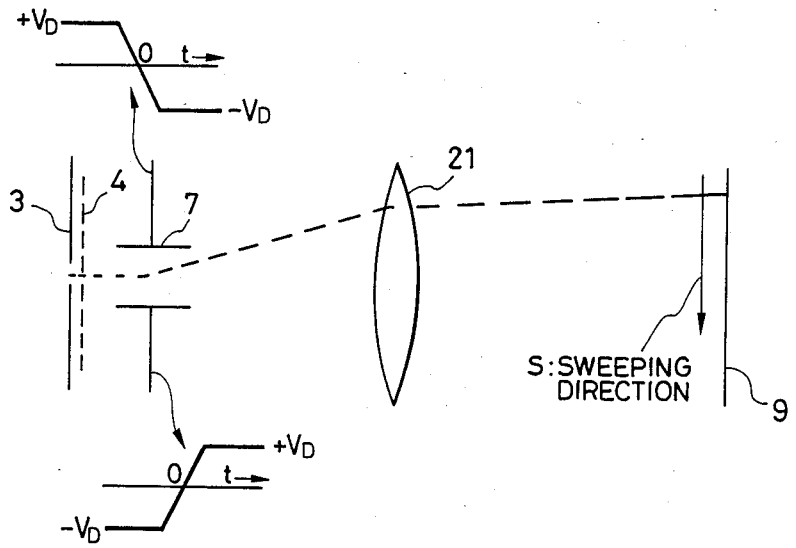
FIG. 14 shows the mechanism by which the spread produced in the direction of the axis of a streak tube is eliminated by the concept of the present invention.

The foregoing embodiments are mainly described with particular emphasis being placed on their effectiveness in minimizing the beam spread that would otherwise be produced in the sweep direction. It should, however, be noted that these embodiments are also effective in eliminating the spread that would produced in the direction of the axis of the streak tube. This is described below with reference to FIG. 14. A spread will be produced on the phosphor screen if photoelectron pulses are deflected by the deflection field after they have spread in the direction of the tube axis. However, according to the present invention described above, the photoelectrons emitted from the photocathode are deflected after they are accelerated by the mesh electrode and the deflected electrons are subsequently focused with the focusing electrode. Therefore, the spread of the photoelectron pulses that are to be deflected by the deflecting electrodes is negligible and the streak image formed on the phosphor screen is not spread at all in the direction of deflection. The photoelectron pulses that have passed between the deflecting electrodes will spread in the direction of tube axis as they move from the focusing lens area to the phosphor screen but this spread is barely duplicated on the phosphor screen. This is because the photoelectrons that spread in the direction of tube axis will keep traveling on substantially the same orbit in the static focusing electromagnetic field until they reach the phosphor screen. However, if, as in the prior art, photoelectron pulses that spread significantly in the direction of tube axis are directed to pass through a deflection field changing rapidly with time, the photoelectrons will be subjected to the action of the deflection field by different amounts between the front and rear portions of the photoelectron pulse and, as a result, the photoelectrons will be dispersed in the sweep direction to produce a spread on the phosphor screen.

In the embodiments described above, the mesh electrode is positioned close to the photocathode, but it may be replaced by a slit electrode having a slit cut in the central portion in such a manner that its longitudinal direction will coincide with that of the linear optical image to be formed on the photocathode. Further, the accelerating electrode may be a disk-type electrode having an aperture at the center thereof. As a further modification, an electromagnetic deflecting means may be employed.

As described above, in the streak tube of the present invention, a photoelectron beam is deflected immediately after it has passed through a mesh electrode while the beam width as measured in the sweep direction still remains to be small and the deflected photoelectron beam is subsequently focused by a focusing electrode. Therefore, the streak tube of the present invention is substantially free from deterioration in time resolution that would otherwise occur upon sweeping and this eliminates the need to perform cumbersome compensations. In addition, the present invention is also effective in minimizing the deterioration in time resolution that might occur on account of the space-charge effect when the light to be measured has an extremely high intensity.

What is claimed is:

1. A streak tube comprising:

an air-tight container having an incident window at one end for receiving an optical image and an exit window at the other end for observing a processed optical image;

a photocathode provided at the inner surface of said incident window for converting said optical image into a photoelectron beam;

accelerating means for accelerating said photoelectron beam;

deflecting means for generating a deflection field short in length and for deflecting said accelerated photoelectron beam, said deflecting means being disposed immediately behind said accelerating means;

focusing means for focusing said deflected photoelectron beam; and a phosphor screen provided at the inner surface of said exit window for receiving said focused photoelectron beam and forming a streak image corresponding to said optical image, said photoelectron beam emitted from said photocathode being deflected immediately after being accelerated by said accelerating means, and subsequently being focused on said phosphor screen with substantially no spread.

2. A streak tube as claimed in claim 1, said streak tube further comprising shielding means for enclosing said deflecting means therein to prevent an influence on said focusing means caused by an asymmetricity of said deflecting means.

3. A streak tube as claimed in claim 2, wherein said shielding means comprises a cylindrical member extending in the direction of tube axis and a lid having a central aperture in alignment with said tube axis.

4. A streak tube as claimed in claim 1, said streak tube further comprising an isolating means for isolating said deflecting means from said focusing means to prevent an influence on said focusing means caused by an asymmetricity of said deflecting means, and wherein said isolating means has an aperture for directing said photoelectron beam from said deflecting means to said focusing means.

5. A streak tube as claimed in claim 1, wherein said deflecting means comprises deflecting electrodes.

6. A streak tube as claimed in claim 1, wherein said accelerating means comprises a mesh electrode.

7. A streak tube as claimed in claim 1, wherein said accelerating means comprises a slit electrode.

8. A streak tube as claimed in claim 1, wherein said accelerating means comprises an electrode with an aperture.

9. A streak tube as claimed in claim 8, wherein said electrode is a disk-type electrode having said aperture at the center thereof.

10. A streak tube as claimed in claim 1, wherein said focusing means comprises an electromagnetic coil positioned between said deflecting means and said phosphor screen.

* * * * *